US005279153A

United States Patent [19]

Dussan V. et al.

[11] Patent Number: 5,279,153

[45] Date of Patent: Jan. 18, 1994

[54] APPARATUS FOR DETERMINING HORIZONTAL AND/OR VERTICAL PERMEABILITY OF AN EARTH FORMATION

[75] Inventors: Elizabeth B. Dussan V.; François M. Auzerais; William E. Kenyon, all of Ridgefield, Conn.

[73] Assignee: Schlumberger Technology Corporation, Ridgefield, Conn.

[21] Appl. No.: 752,724

[22] Filed: Aug. 30, 1991

[51] Int. Cl.[5] ..... E21B 49/00

[52] U.S. Cl. ..... 73/155; 166/100

[58] Field of Search ..... 73/155, 152, 38; 166/100

[56] References Cited

U.S. PATENT DOCUMENTS

| | | | |
|---|---|---|---|
| 3,181,608 | 5/1965 | Palmer | 73/155 |
| 3,396,796 | 8/1968 | Voetter | 166/100 |
| 3,780,575 | 12/1973 | Urbanosky | 73/152 |
| 3,952,588 | 4/1976 | Whitten | 73/155 |
| 4,470,456 | 9/1984 | Moutray, III | 73/155 |
| 4,742,459 | 5/1988 | Lasseter | 364/422 |
| 4,890,487 | 1/1990 | Dussan V. et al. | 73/152 |

OTHER PUBLICATIONS

E. B. Dussan V. et al., *An Analysis of the Pressure Response of a Single-Probe Formation Tester, SPE Paper No. 16801,* presented at the 62nd Annual Technical Conference and Exhibition of the Society of Petroleum Engineers (1987).

R. Eijpe et al., *Geological Note: Mini-Permeameters for Consolidated Rock and Unconsolidated Sand, The American Association of Petroleum Geologists Bulletin,* vol. 55, No. 2, (1971) pp. 307-309.

C. McPhee, *Proposed Mini-Permeameter Evaluation Report, Edinburgh Petroleum Equipment, Ltd.,* Edinburgh, Scotland (1987).

D. Goggin et al., *A Theoretical and Experimental Analysis of Minipermeameter Response Including Gas Slippage and High Velocity Flow Effects, In Situ,* 12 (1 and 2), (1988), pp. 79-116.

*Primary Examiner*—Hezron E. Williams
*Assistant Examiner*—Michael Brock
*Attorney, Agent, or Firm*—Marc D. Foodman; Leonard W. Pojunas

[57] ABSTRACT

Apparatus for obtaining horizontal and/or vertical permeability measurements through a probe having an elongate aperture. The invention uses the elongate aperture in the probe to orient fluid flow in an earth formation horizontally or vertically. The elongate aperture is approximated through the use of a single elongate opening or through the use of a group of aligned openings of varying shapes. Measurements can be taken at different orientations by including additional probe openings along more than one axis.

24 Claims, 11 Drawing Sheets

APPARATUS FOR DETERMINING HORIZONTAL AND/OR VERTICAL PERMEABILITY OF AN EARTH FORMATION

BACKGROUND OF THE INVENTION

The present invention relates generally to measuring horizontal and/or vertical permeability of an earth formation. More particularly, the invention is directed to a probe for providing displacement of fluid in an earth formation. Methods for interpreting measurements obtained with the use of the probe of the present invention are disclosed in copending patent application Ser. No. 722,052 to Auzerais and Dussan V. and assigned to Schlumberger Technology Corporation herein incorporated by reference.

The permeability of an earth formation containing valuable resources such as liquid or gaseous hydrocarbons is a parameter of major significance to their economic production. These resources can be located by borehole logging to measure such parameters as the resistivity and porosity of the formation in the vicinity of a borehole traversing the formation. Such measurements enable porous zones to be identified and their water saturation (percentage of pore space occupied by water) to be estimated. A value of water saturation significantly less than one is taken as being indicative of the presence of hydrocarbons, and may also be used to estimate their quantity. However, this information alone is not necessarily adequate for a decision on whether the hydrocarbons are economically producible. The pore spaces containing the hydrocarbons may be isolated or only slightly interconnected, in which case the hydrocarbons will be unable to flow through the formation to the borehole. The ease with which fluids can flow through the formation, the permeability, should preferably exceed some threshold value to assure the economic feasibility of turning the borehole into a producing well. This threshold value may vary depending on such characteristics as the viscosity of the fluid. For example, a highly viscous oil will not flow easily in low permeability conditions and if water injection is to be used to promote production there may be a risk of premature water breakthrough at the producing well.

The permeability of a formation is not necessarily isotropic. In particular, the permeability of sedimentary rock in a generally horizontal direction (parallel to bedding planes of the rock) may be different from, and typically greater than, the value for flow in a generally vertical direction. This frequently arises from alternating horizontal layers consisting of large and small size formation particles such as different sized sand grains or clay. Where the permeability is strongly anisotropic, determining the existence and degree of the anisotropy is important to economic production of hydrocarbons.

Techniques for estimating formation permeability are known. One technique involves measurements made with a repeat formation testing tool of the type described in U.S. Pat. Nos. 3,780,575 to Urbanosky and 3,952,588 to Whitten, such as the Schlumberger RFT TM tool. A tool of this type provides the capability for repeatedly taking two successive "pretest" samples at different flow rates from a formation via a single probe inserted into a borehole wall and having an aperture of circular cross-section. The fluid pressure is monitored and recorded throughout the sample extraction period and for a period of time thereafter. Analysis of the pressure variations with time during the sample extractions ("draw-down") and the subsequent return to initial conditions ("build-up") enables a value for an effective formation permeability to be derived for each of the draw-down and build-up phases of operation.

FIG. 1 illustrates schematically the principal elements of a tool employed in taking "pretest" samples. The tip 110 of a circular probe is inserted through mud cake 112 into the borehole wall. Mud cake 112 and a packer 114 hydraulically seal the probe tip 110 with respect to the formation 116. The probe includes a filter 118 disposed in the probe aperture and a filter-cleaning piston 120. The pretest system comprises chambers 122 and 124 and associated pistons 126 and 128. Pistons 126 and 128 are retracted in sequence each time the probe is set. Piston 126 is withdrawn first, drawing in formation fluid at a flow rate of, for example, 50 cc/min. Then piston 128 is withdrawn, causing a flow rate of, for example, 125 cc/min. FIG. 1 shows the system in mid-sequence, with piston 126 withdrawn. A strain gauge sensor 132 measures pressure in line 134 continuously during the sequence. The probe is retracted, the pistons 126 and 128 are moved to expel the fluid, and filter cleaning piston 120 pushes debris from the probe.

The pressure measurement is recorded continuously in analog and/or digital form. FIG. 2 shows a typical analog pressure recording during pretest. A pressure drawn-down $\Delta p_1$ is recorded as piston 126 is withdrawn during a time period $T_1$, and a pressure draw-down $\Delta p_2$ is recorded as piston 128 is withdrawn during a time period $T_2$. When pretest chambers 122 and 124 are full (at time $t_2$), the pressure begins to build up over a time period $\Delta t$ toward a final pressure, that of the formation.

The permeability has been estimated by analyzing the pressure recording during either buildup or drawdown. As illustrated in FIG. 3, the point 310 at which the probe tip 110 is applied to the wall of the borehole 312 coincides with the center of the latter stage of the pressure disturbance during buildup. From the perspective of a coordinate system whose axes have been suitably stretched by an amount dictated by the horizontal and vertical components of the permeability, the pressure disturbance appears to be propagating spherically outward from the probe tip 110. Thus the analysis yields a single "spherical" permeability value, consisting of a specific combination of both the horizontal and vertical components of the permeability. During drawdown, the pressure disturbance has only been analyzed for the case of a homogeneous formation with isotropic permeability. For the anisotropic case, the ad hoc assumption has been made that the isotropic permeability be replaced by the "spherical" permeability. Only in some cases could the analysis yield separate values for horizontal and vertical permeabilities, and then only with the incorporation of data from other logging tools or from laboratory analysis of formation core samples. Until recently, it had been assumed impossible to derive separate horizontal and vertical permeability values solely from the measurements provided by the single-probe type of tool.

Another method of estimating formation permeability is described in U.S. Pat. No. 4,742,459 to Lasseter. FIG. 4 shows in schematic form a borehole logging device 400 useful in practicing the method. In this approach, formation pressure responses vs. time are measured at two observation probes (402 and 404) of circular cross-section as a transient pressure disturbance is established in the formation 406 surrounding the borehole 408 by means of a "source" probe 410. The observation probes are spaced apart in the borehole, probe 404 (the "horizontal" probe) being displaced from source probe 410 in the lateral direction and probe 402 (the "vertical" probe) being displaced from source probe 410 in the longitudinal direction. Hydraulic properties of the surrounding formation, such as values of the anisotropic permeability and the associated hydraulic anisotropy, are derived from the measured pressure responses.

While the technique of this patent has advantages, the use of multiple spaced-apart probes has some inherent drawbacks. For example, the MRTT TM and MDT TM tools commercialized by Schlumberger and employing principles of the Lasseter patent have the observation probes spaced some 70 cm. apart along the borehole. The estimate of vertical permeability is thus based on flow over a relatively large vertical distance. While this is sometimes appropriate, it is often preferable to obtain a more localized value of vertical permeability. If the longitudinally-spaced observation probes are set so that they straddle a hydraulic barrier in the formation (e.g., a formation layer of low permeability relative to the layers in which the probes are set), the values determined for vertical permeability and hydraulic anisotropy may differ significantly from the local characteristics of the formation layers above and below the barrier. Moreover, the technique of the Lasseter patent may require simultaneous hydraulic seating of three probes, though it may be possible to make both horizontal and vertical measurements with only two probes. Accurate measurement may be prevented if one or more of the probes fails to seal properly, such as where the borehole surface is uneven. While even a single-probe system can encounter seating problems, the need for simultaneous seating of multiple probes may increase the difficulty of obtaining the desired measurement.

A method for determining the various components of the permeability of an anisotropic formation with a single probe is described in U.S. Pat. No. 4,890,487 to Dussan V. et al. See also E. B. Dussan V. et al., *An analysis of the Pressure Response of a Single-Probe Formation Tester*, SPE Paper No. 16801, presented at the 62nd Annual Technical Conference and Exhibition of the Society of Petroleum Engineers (1987). Pressure draw-down and build-up are measured as fluid samples are extracted from the formation at controlled flow rates with a logging tool having a single extraction probe of circular cross-section. This may be done with a system as shown in FIG. 1, producing a pressure recording as shown in FIG. 2. The measured build-up and draw-down data are analyzed to derive separate values for horizontal and vertical formation permeability. This is possible because they successfully analyze the pressure disturbance during draw-down for an anisotropic formation. This technique offers a localized determination of hydraulic anisotropy, and avoids the need to incorporate data from other logging tools or core analysis. It has the disadvantage that it relies on measurement of pressure build-up, which demands an extremely fast-responding pressure transducer with a very high sensitivity. Pressure draw-down is a relatively robust measurement—pressure is measured before and after the pressure disturbance caused by fluid extraction. Pressure build-up is a more delicate measurement because the rate of pressure recovery must be measured accurately as the detected pressure asymptotically approaches formation pressure (the pressure recovers at a rate of $1/t^{3/2}$).

A further technique for determining permeability is performed in the laboratory using formation samples and a laboratory instrument known as a minipermameter. The instrument has an injection probe with a nozzle of circular cross-section which is pressed against the surface of a sample and appropriately sealed. Pressurized gas flows through the injection nozzle into the rock sample as gas flow and injection pressure are measured. Referring to the schematic view of FIG. 5, the process may be performed on a first face 510 having its longitudinal (z) axis perpendicular to the bedding planes of a formation sample 500 and on a second face 520 having its longitudinal (x and y) axis parallel to the bedding planes of the formation sample. The measured flows through the sample are used in determining permeability. See, for example, R. Eijpe et al., *Geological Note: Mini-Permeameters for Consolidated Rock and Unconsolidated Sand, The American Association of Petroleum Geologists Bulletin*, Vol. 55, No. 2, pp. 307–309 (1971); C. McPhee, *Proposed Mini-Permeameter Evaluation Report, Edinburgh Petroleum Equipment. Ltd.*, Edinburgh, Scotland (1987); and D. Goggin et al., *A Theoretical and Experimental Analysis if Minipermeameter Response Including Gas Slippage and High Velocity Flow Effects, In Situ*, 12(1 and 2), pp. 79–116 (1988).

Determining horizontal and/or vertical permeabilities of a formation with a mini-permeameter has a number of important limitations. The mini-permeameter is a laboratory instrument, and cannot be used to make in situ measurements in a well bore. Thus, it can only be used to make the necessary measurements if formation core samples are available, which is not always the case. Moreover, it entails destruction of portions of the core sample, as a smaller sample having a smooth face parallel to and perpendicular to the bedding planes must be cut from the sample for testing. Also, the mini-permeameter measures the permeability of isotropic samples, in the case of an anisotropic sample, it only gives an effective value. Thus, it would only give an effective vertical and effective horizontal permeability from the two faces 510 and 520, respectively.

SUMMARY OF THE INVENTION

The invention, as described, provides an apparatus for making determinations of horizontal and vertical permeabilities of an earth formation. Further, it provides an apparatus with a single probe for distinguishing between horizontal and vertical permeability in a single measurement. The invention also provides an apparatus which avoids limitations of the prior art methods described above. These and other features are attained in accordance with exemplary embodiments of the invention described below.

In a preferred embodiment, fluid flow measurements are made in situ using a repeat formation tester and a modified probe aperture, or a mini-permeameter with a modified probe aperture. The modified probe aperture has an elongate cross-section, such as elliptic or rectangular. Alternatively, the probe aperture may include a plurality of openings of varying shapes which are aligned to approximate an elongate aperture. A first flow measurement is made with the longer dimension of the probe aperture in a first orientation (e.g., horizontal or vertical) with respect to the formation bedding planes. A second flow measurement is made with the probe aperture orthogonal to the first orientation.

BRIEF DESCRIPTION OF THE DRAWINGS

Preferred embodiments of the invention are described in more detail below with reference to the accompanying drawing, in which.

DETAILED DESCRIPTION OF THE PREFERRED EMBODIMENTS

The invention concerns an apparatus including a probe with an elongate aperture for obtaining measurements useful in the estimation of horizontal and/or vertical components of permeability of an anisotropic earth formation. For purposes of this description, the "horizontal" direction is generally parallel to the bedding planes of the rock. and the "vertical" direction is generally perpendicular to the bedding planes of the rock. The term "formation" comprises a formation sample, such as a core plug taken from a borehole. These terms have been chosen to simplify explanation of the invention. They should in no way be construed to limit the invention which is defined by the appended claims. In the case of a formation sample, "formation fluid" may be a liquid or a gas such as atmospheric air.

In accordance with the invention, flow measurements are made to obtain values from which the permeability components of an earth formation are estimated. The flow measurements may be conducted in situ and/or in the laboratory using formation samples. In situ measurements are preferably made in a borehole with a formation test tool having a probe aperture modified as described below. Formation test tools which may be employed include the Schlumberger RFT TM tester, MRTT TM tester and MDT TM tester. Laboratory measurements and measurements on outcrops are preferably made with a minipermeameter having a probe aperture modified as described below.

The technique can be performed using a single probe. Pressure measurements are taken at the probe, through which fluid is forced to flow under substantially steady-state, single-phase conditions. For downhole measurements, the flow is preferably induced by drawing formation fluid into the tool through the probe ("draw-down"). Alternatively, fluid may be injected into the formation through the probe ("injection"). Gas injection is preferred for laboratory measurements with formation samples. Whether fluid is drawn into the probe or injected out through the probe, a pressure disturbance is caused in the formation fluid.

Figure 6:
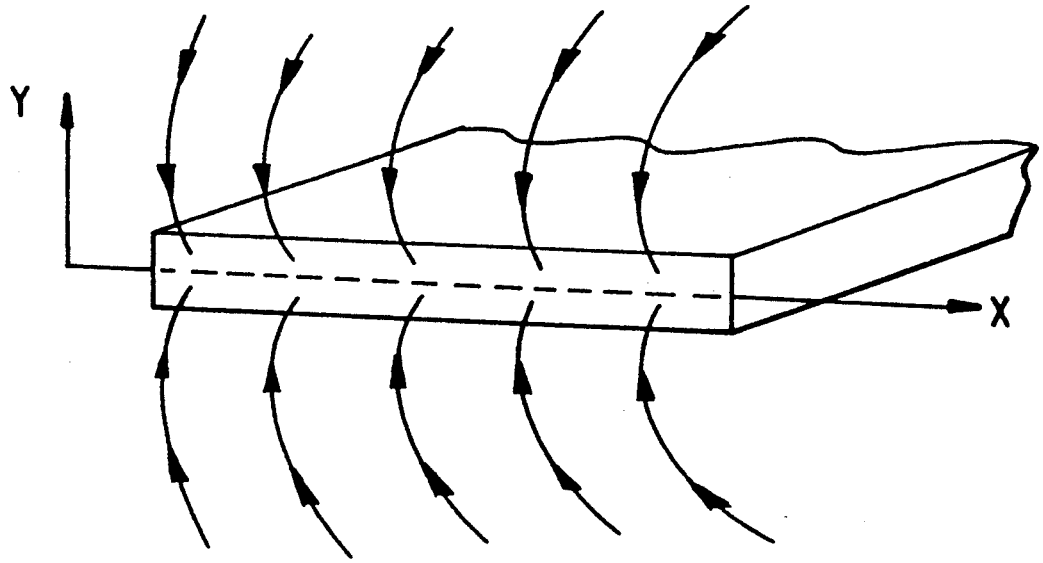
FIG. 6 illustrates generally vertical fluid flow into a horizontally-oriented, elongate probe aperture in accordance with the invention.
Figure 7:
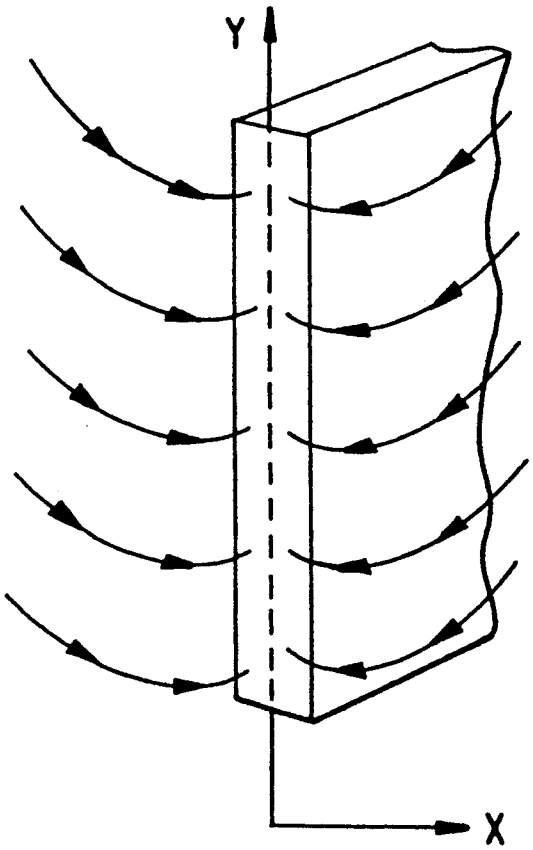
FIG. 7 illustrates generally horizontal fluid flow into a vertically-oriented, elongate probe aperture in accordance with the invention.

Preferred methods of estimating horizontal and/or vertical permeability in accordance with the invention differ in at least two significant ways from the prior art methods described above. First, a probe having an aperture of non-circular cross-section is employed. The probe is that part of the tool or instrument in contact with the formation or formation specimen. Fluid is displaced through the probe aperture in making a measurement. The aperture is preferably shaped as a narrow slit, a small aspect ratio (width/length) being of more importance than the exact shape of the cross-section. The slit shape allows fluid to be drawn or injected in a pattern which corresponds to the direction of the measurement. For example, FIG. 6 shows the probe oriented horizontally. As can be seen from the flow lines in FIG. 6, the fluid enters the probe (in the case of draw-down) along the vertical axis Y. Similarly, FIG. 7 shows the probe oriented vertically. The flow lines in FIG. 7 show the fluid entering the probe (in the case of a draw-down) along a horizontal axis X. The limit on the smallness of the aspect ratio results from a desire to avoid clogging, and the size of the diameter (maximum length) of the probe. The aspect ratio as defined (width/length) is less than 1.0.

Second, measurements are taken during two pressure disturbances (e.g., during two draw-downs), with the aperture oriented in two different directions with respect to the formation or formation specimen during the two measurements. For example, the aperture is oriented in a first direction (e.g., horizontal) during a first draw-down, and is oriented in a second direction (e.g., vertical) orthogonal to the first direction during a second draw-down. The "orientation" is the direction of the longest dimension of the aperture cross-section.

A number of variations are possible. For example, the non-circular aperture cross-section may be generally elliptic or rectangular or of some other elongate or slit-like form. Instead of pressure draw-downs caused by withdrawal of fluid from the formation, pressure increases caused by injection of fluid into the formation may be used. A combination of a pressure draw-down and a pressure increase (injection) may be used in place of two draw-downs. Probes with two different aperture cross-sections may be used for the two pressure disturbance (draw-down and/or injection) measurements—for example, one of the aperture cross-sections can be circular, provided the other aperture cross-section has a small aspect ratio (ratio of width to length).

Figure 8:
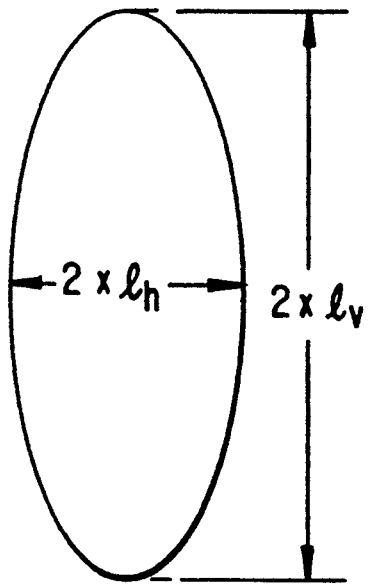
FIG. 8 shows a probe aperture in accordance with the invention having a cross-section of an elliptical shape of "width" $2\times l_h$ and "length" $2\times l_v$.

Determination of horizontal and/or vertical permeability in accordance with the preferred embodiments is based upon our derived relationship among the following parameters: the volumetric flow rate, Q, and the viscosity, $\mu$, of the fluid forced to pass through the aperture of the probe during draw-down or injection, the horizontal, $k_h$, and vertical $k_v$, components of the permeability of the formation, the pressure at the probe, $P_p$, the pressure of the formation far from the probe (equivalent to the pressure measured by the probe when the formation fluid is in its undisturbed state), $P_f$, and the probe aperture dimensions $2\times l_h$ and $2\times l_v$ shown in FIG. 8. The relationship between these parameters and the details for interpreting the horizontal and/or vertical permeabilities from the flow measurements obtained through the probe are discussed in copending U.S. patent application Ser. No. 722,052 to Auzerais and Dussan V. and assigned to Schlumberger Technology Corporation.

Figure 9:
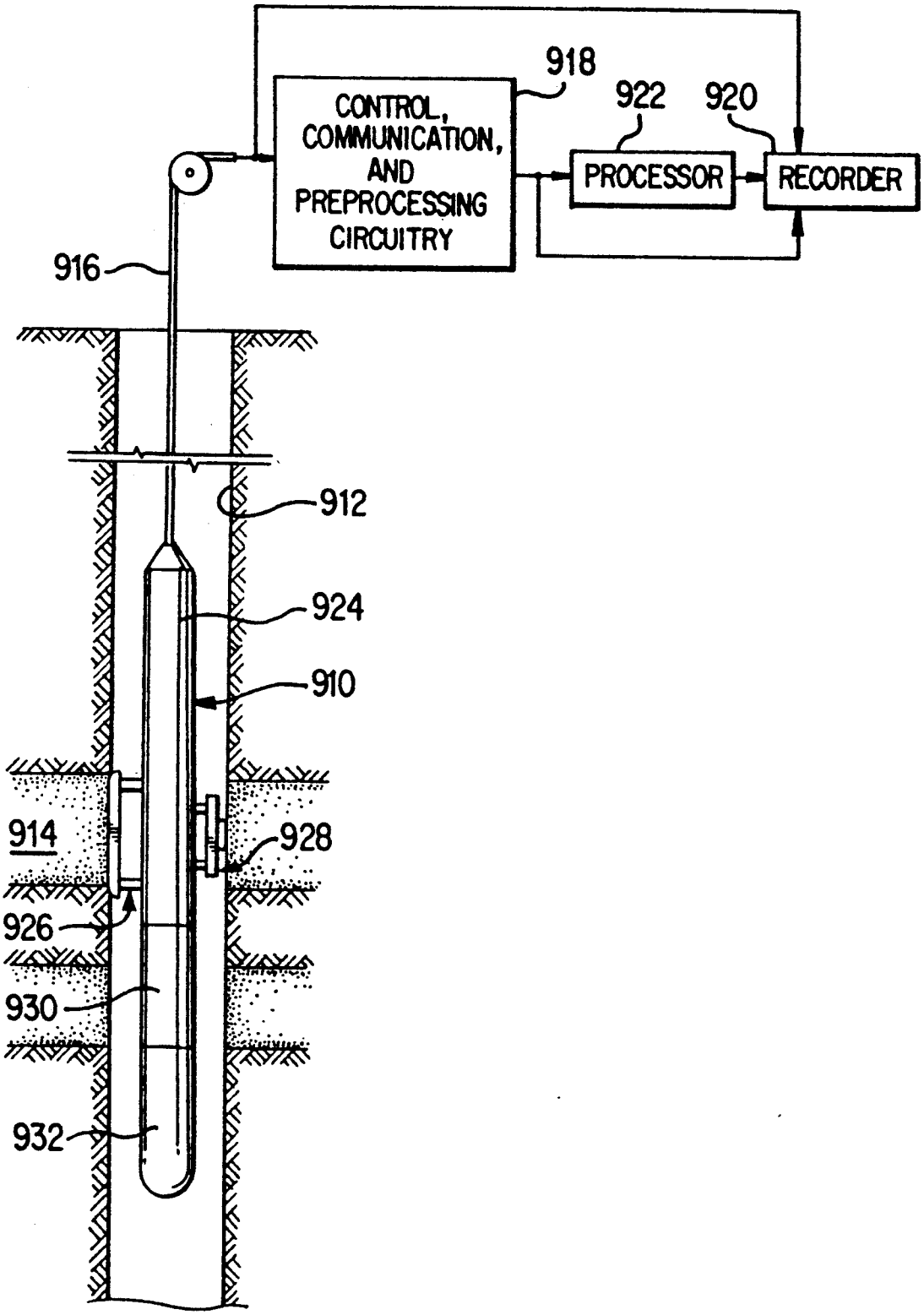
FIG. 9 illustrates a logging tool for sampling and measuring fluid flow in an earth formation.

The apparatus of the present invention may take a variety of forms provided the overall cross-section maintains an aspect ratio of less than 1.0 . FIG. 9 shows a sampling and measuring tool 910 in a well bore such as an uncased borehole 912 penetrating one or more earth formations as at 914. Tool 910 is suspended in the borehole 912 from the lower end of a typical multiconductor cable 916 that is spooled in the usual fashion on a suitable winch (not shown) at the surface. Tool 910 is coupled to a surface portion 918 of a tool control system comprising control, communication and preprocessing circuitry, a power supply and the like. Tool 910 is also coupled to a typical recording and indicating apparatus 920. A processor 922 communicates with tool control system portion 918 and with recording and indicating apparatus 920 for receiving and processing data. Processor 922 is preferably a suitably-programmed general-purpose computer system, though a suitable special-purpose digital or analog computer could alternatively be employed.

As shown, tool 910 includes a body 924 which encloses a downhole portion of the tool control system, and carries selectively-extendible tool-anchoring means 926. Body 924 also carries a probe assembly 928 and multiple fluid-collecting chambers, two such chambers being shown at 930 and 932. Upon command from the surface, tool-anchoring means 926 is extended and the probe assembly 928 is applied to the formation by the tool control system. Probe assembly 928 is equipped for selectively sealing off or isolating selected portions of the wall of the borehole 912, and establishing pressure or fluid communication with the adjacent earth formation, as at 914.

Figure 10:
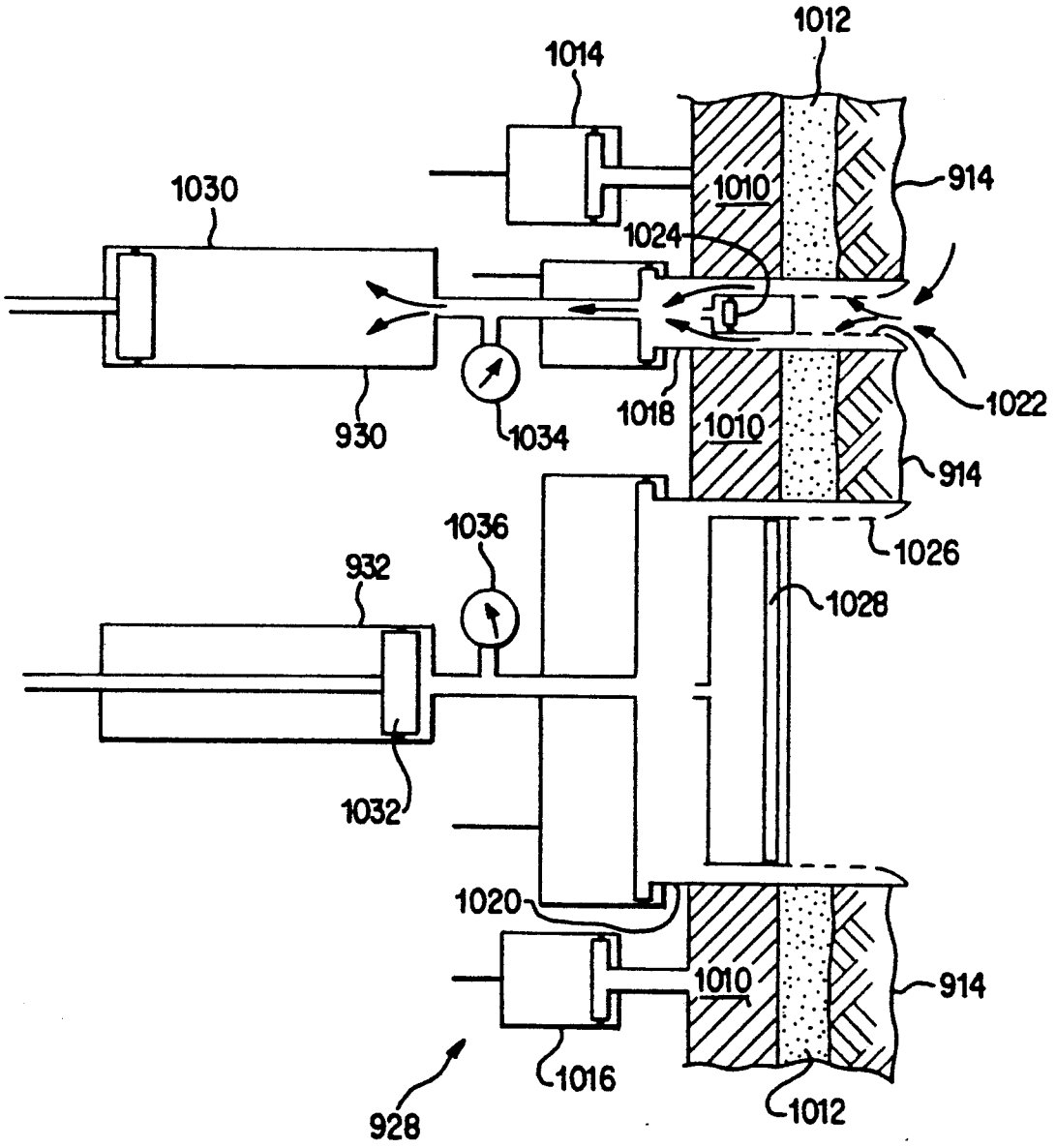
FIG. 10 illustrates the principal elements of a probe assembly for the tool of FIG. 9.

FIG. 10 illustrates schematically the principal elements of a preferred probe assembly 928 and related elements of tool 910 employed in taking measurements in accordance with the invention. Probe assembly 928 includes a packer 1010 which is applied to a mudcake layer 1012 of the borehole wall by suitable means such as hydraulically-actuated pistons 1014 and 1016. Sampling probes 1018 and 1020 are forced outwardly through apertures in packer 1010 by suitable means so that their tips penetrate the mudcake layer 1012. Probes 1018 and 1020 may also be hydraulically-actuated. FIG. 10 shows packer 1010 and probes 1018 and 1020 in their extended positions, with the apertures of probes 1018 and 1020 in fluid communication with formation 914. Packer 1010 and mudcake layer 1012 effect a seal between formation 914 and the probe apertures.

Each probe may include a filter disposed in the probe aperture and a filter-cleaning piston. As illustrated, probe 1018 includes a filter 1022 and a filter-cleaning piston 1024, and probe 1020 includes a filter 1026 and a filter-cleaning piston 1028. Chambers 930 and 932 are fitted with respective pistons 1030 and 1032. As piston 1030 is withdrawn (illustrated), fluid flows from the formation 914 through filter 1022 and into chamber 930. The arrows indicate the flow of fluid during a pressure drawdown. Pressure is preferably measured before and continuously during drawdown through probe 1018 by a pressure sensor shown schematically at 1034. As piston 1032 is withdrawn, fluid flows from the formation 914 through filter 1026 and into chamber 932. Pressure is preferably measured before and continuously during drawdown through probe 1020 by a pressure sensor shown schematically at 1036.

Probes 1018 and 1020 may each have an elongate aperture (e.g., of elliptical or rectangular cross-section) as described above, or one may have an elongate aperture and the other a circular aperture, as described above. Probes 1018 and 1020 need not be part of a single pad assembly, but may, for example, each have an independent pad assembly with independently-operable actuators for applying the pad and probe to the formation.

Alternatively, the tool may have a single probe (such as probe 1018), the probe being mounted to the tool 910 such that its aperture can be selectively oriented relative to the bedding planes of the formation. For example, additional actuating means (not illustrated) may be provided for selectively orienting the probe aperture in a horizontal position (as probe 1018 as shown in FIG. 10) or in a vertical position (as probe 1020 as shown in FIG. 10). A first measurement is made with the aperture in one of the two positions, then the probe is retracted, reoriented and re-applied and a second measurement is made with the aperture in the other of the two positions.

Figure 11A:
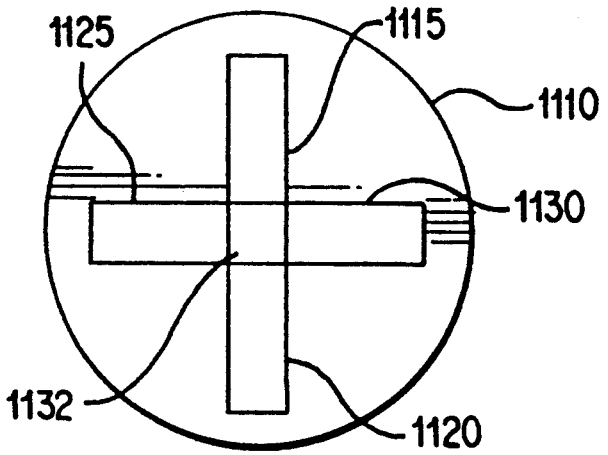
FIGS. 11A–F illustrate a variety of embodiments of the probe aperture for the probe of FIG. 10.

A wide range of modifications of the described probe apertures are possible. For example, the probe may have multiple flow channels or ports. The apertures are controlled by valves within the formation test tool. Opening and closing the valves appropriately gives a flow configuration with either the long axis along the formation bedding planes or perpendicular to them, as required. Many possible configurations of ports are suitable, as shown in the schematic view of FIGS. 11A–F. FIG. 11A illustrates schematically a single probe 1110 faced with a sealing material and having multiple apertures. Apertures 1115 and 1120 are oriented in the vertical direction and apertures 1125 and 1130 are oriented in the horizontal direction. Aperture 1132 is centrally located and is operative for both the horizontal and vertical directions. The multiple apertures approximate the action of a single elongate opening in the probe which contacts the earth formation. By segmenting the elongate aperture into multiple apertures, the need for a retraction of the probe and a resetting at an orthogonal orientation is eliminated.

Figure 11D:
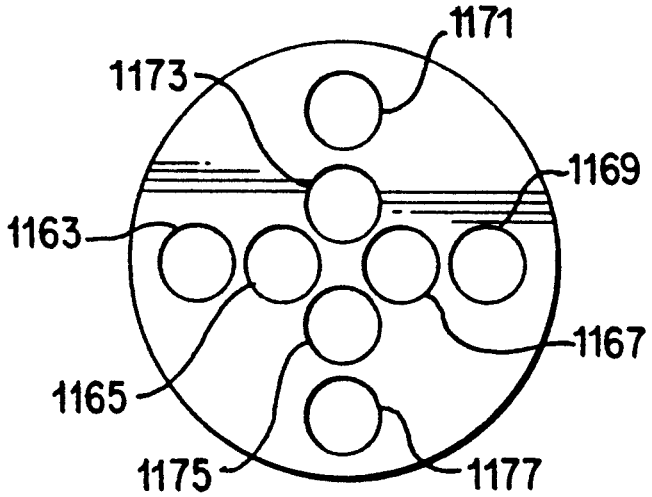
Figure 11F:
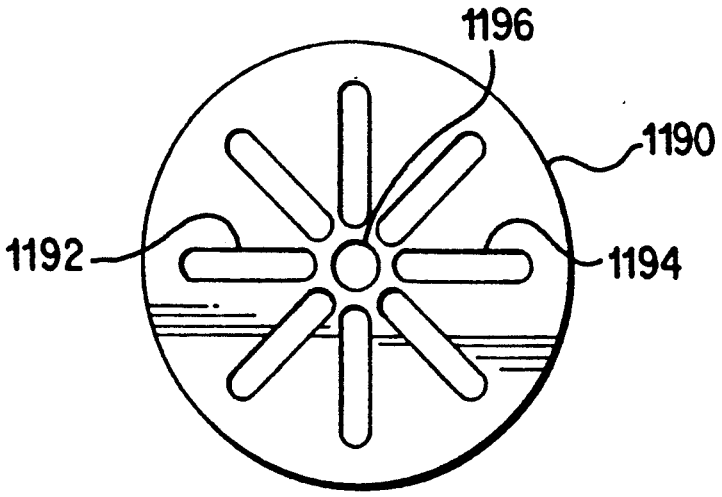
Figure 11B:
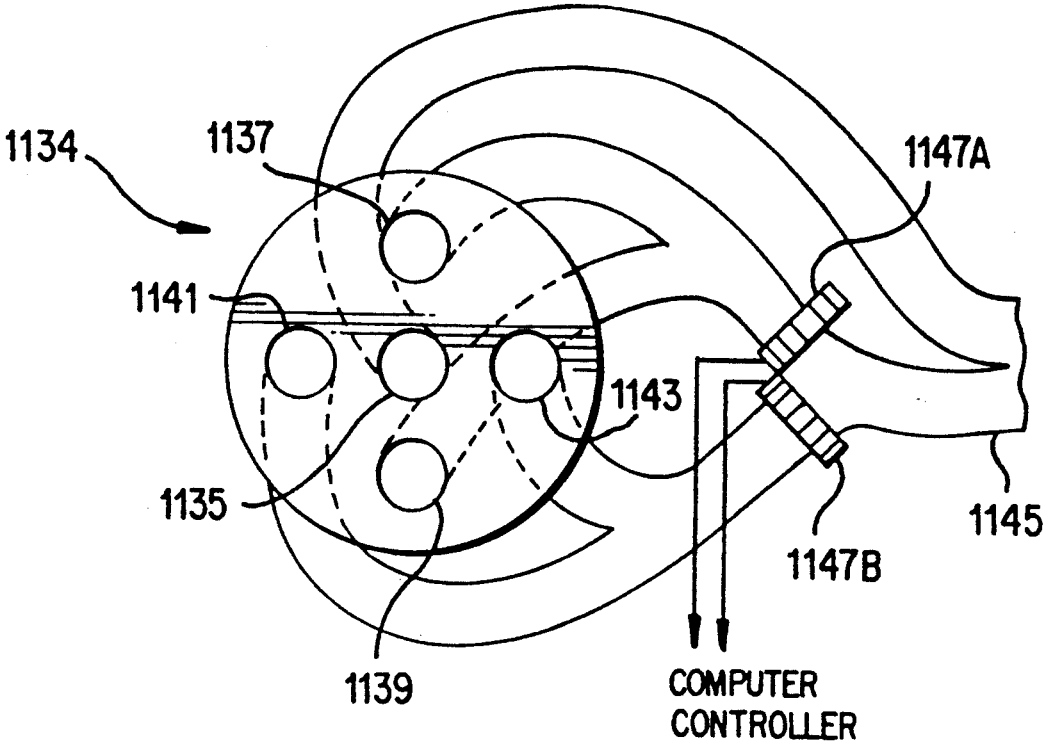

FIG. 11B shows an alternative embodiment for that shown in FIG. 11A. In this embodiment, a plurality of apertures having a circular cross-section are used to approximate the flow through an elongate opening. As with the aperture of FIG. 11A, a central opening 1136 is used for both the horizontal and vertical flow measurement. In addition, during the vertical measurement, a group of linearly aligned probes of circular cross-section are opened at the same time as central opening 1135. A second plurality of linearly aligned openings of circular cross-section 1141 and 1143 are positioned in the horizontal direction. During the horizontal measurement, these openings are activated along with central opening 1135 to obtain vertical permeability.

Figure 1:
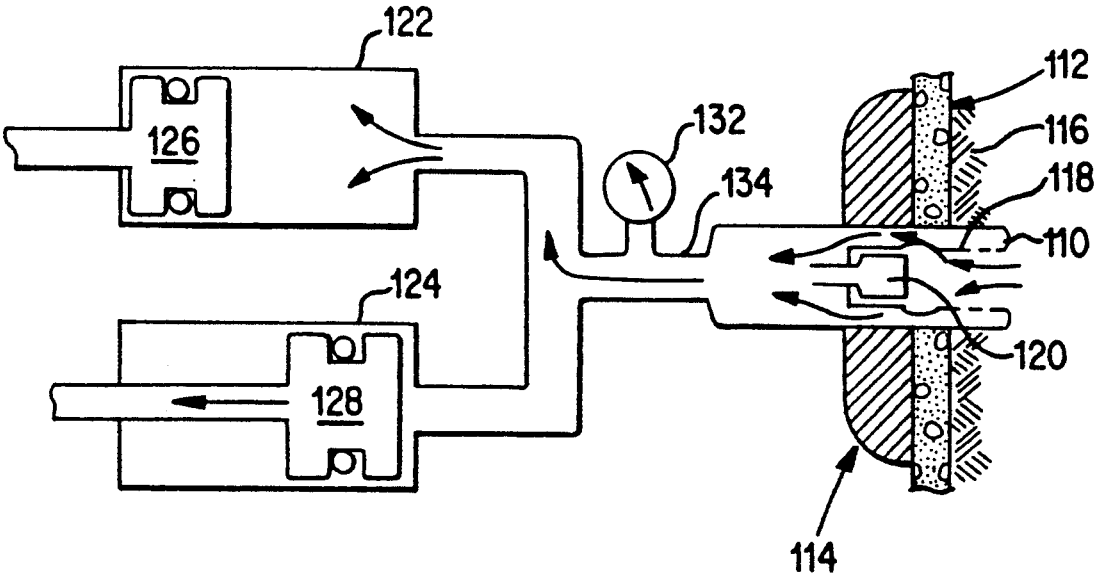
FIG. 1 PRIOR ART
FIG. 1 illustrates schematically the principal elements of a prior-art tool employed in taking "pretest" formation fluid samples in a borehole.
Figure 2:
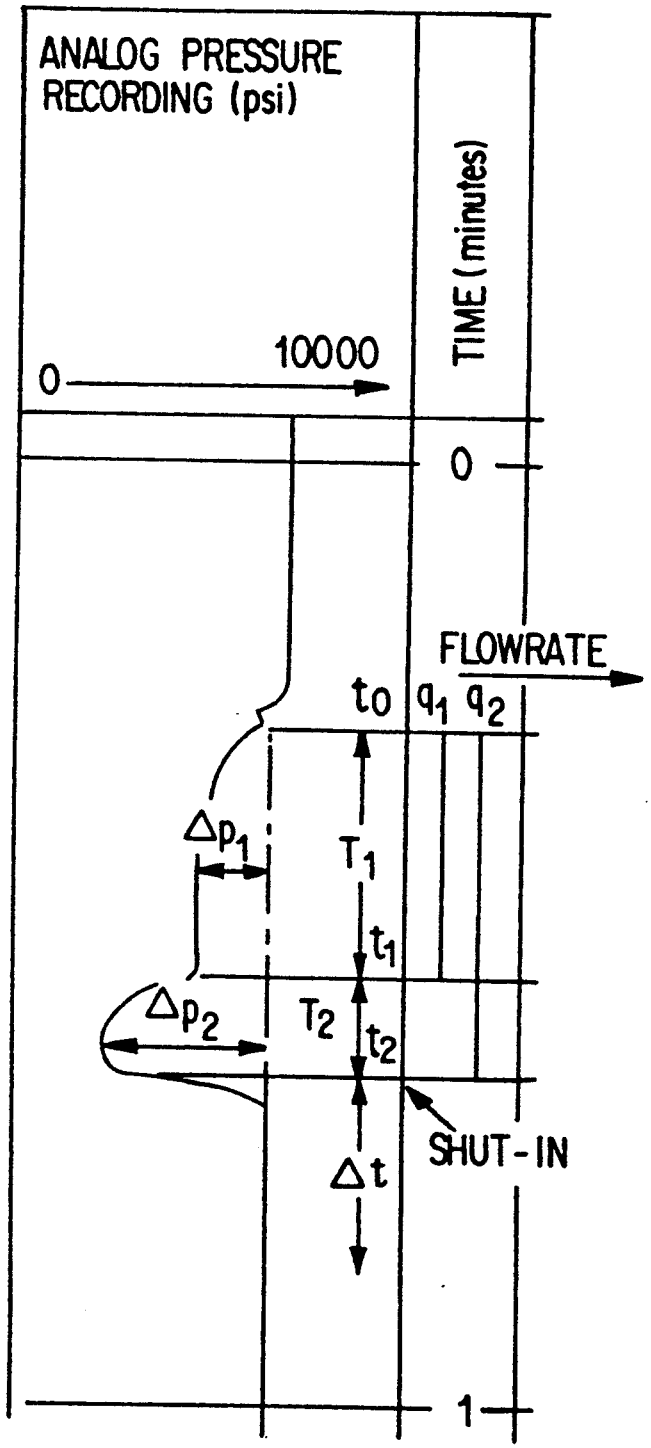
FIG. 2 PRIOR ART
FIG. 2 shows a typical analog pressure recording made during pretest sampling with a tool of the type shown in FIG. 1.
Figure 3:
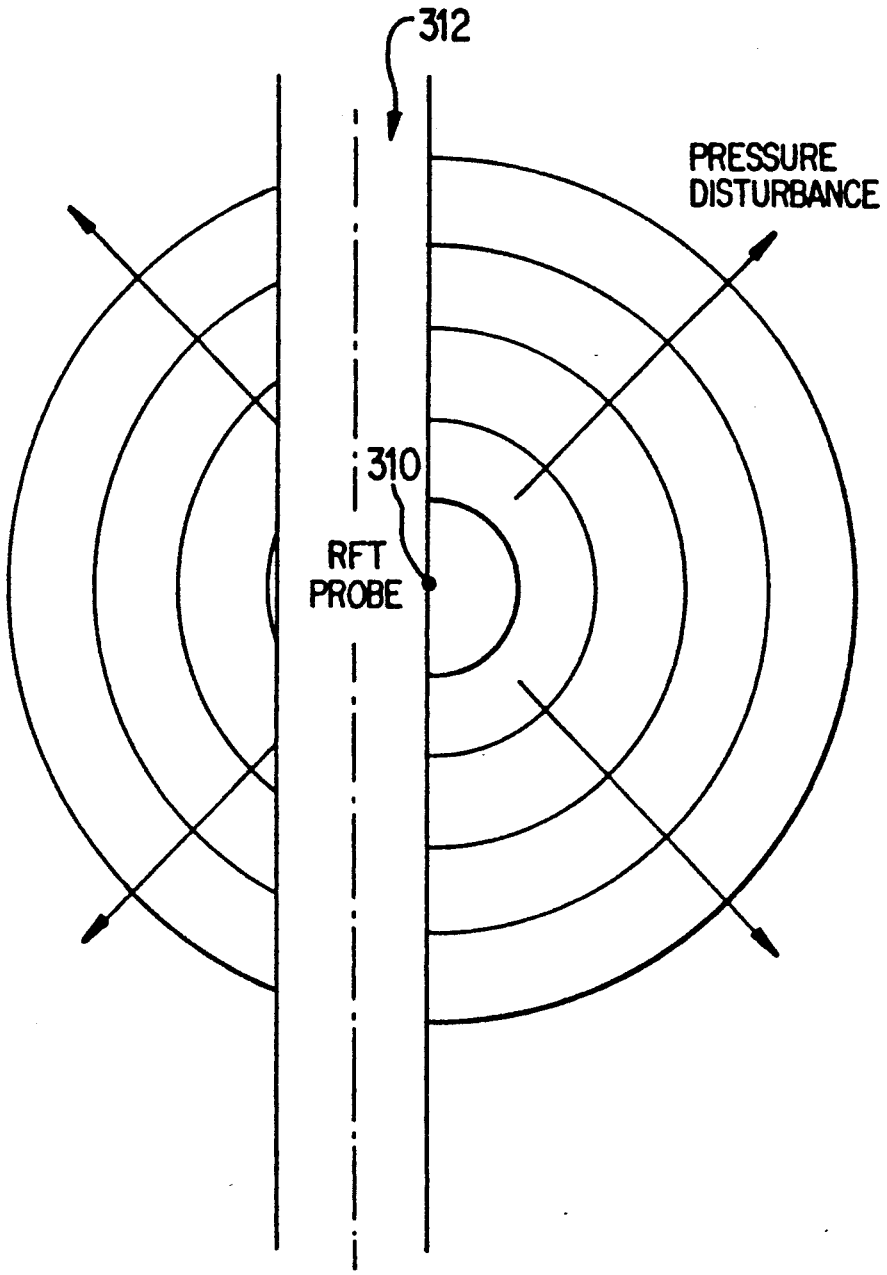
FIG. 3 PRIOR ART
FIG. 3 illustrates a prior-art model of a pressure disturbance in a formation.
Figure 4:
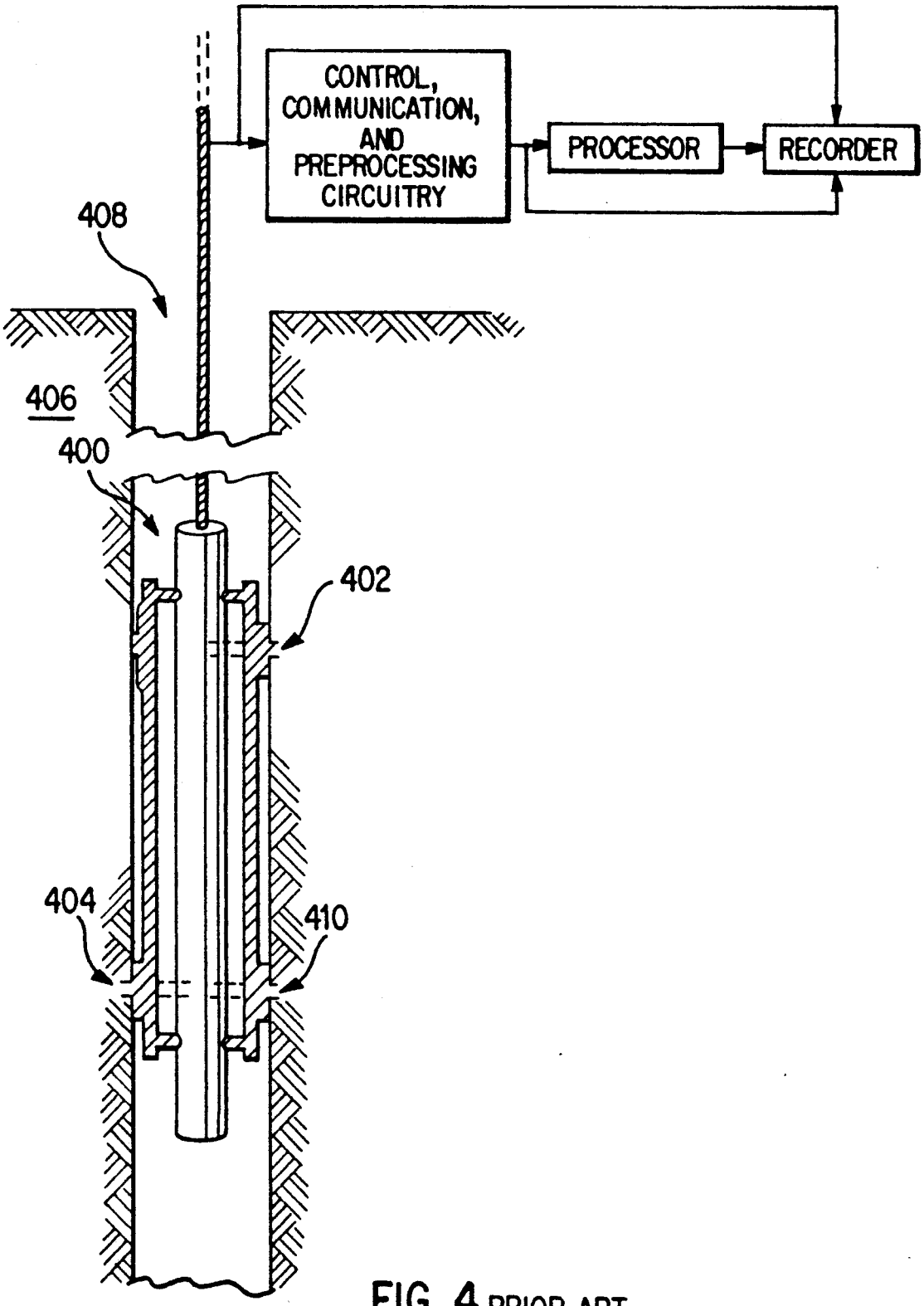
FIG. 4 PRIOR ART
FIG. 4 illustrates schematically a prior-art borehole logging device having a source probe and a spaced-apart pair of observation probes for formation testing.
Figure 5:
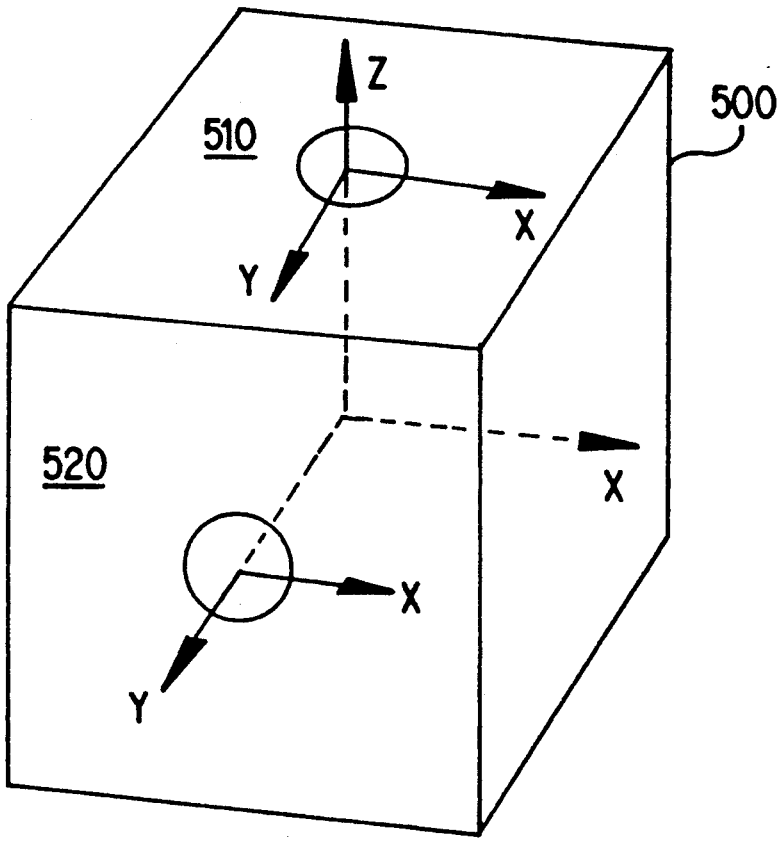
FIG. 5 PRIOR ART
FIG. 5 illustrates a formation sample used for minipermeameter testing in accordance with the prior art.

The apertures communicate with a manifold 1145 having controllable flow valves 1147. At a first point in time, flow valve 1147A is activated, and apertures 1137 and 1139 communicate with a pipe leading to the pretest sample chambers of a formation tester (see FIG. 1). At a second point in time, flow valve 1147B is activated and apertures 1141 and 1143 communicate with the sample chambers. Aperture 1135 is always communicative with the chambers as it is used for both orientations. By suitable control of valve 1147, two draw-down measurements (or two injection measurements) can be effected in accordance with the invention, without need to withdraw and re-set the probe in the borehole wall. It should be understood that an appropriately modified manifold arrangement similar to that of FIG. 11B also applies to the embodiment of FIG. 11A as well as those of FIGS. 11C–F.

Figure 11E:
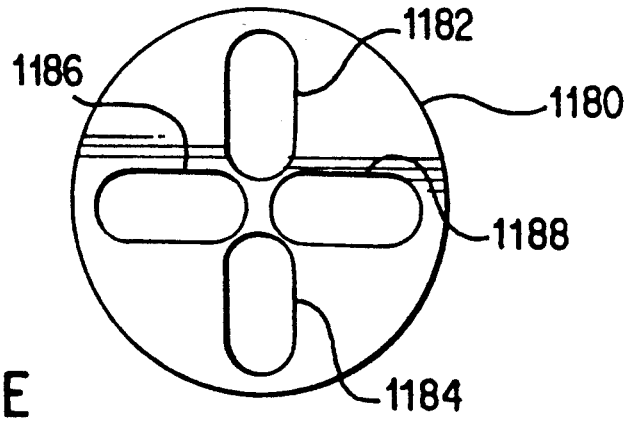
Figure 11C:
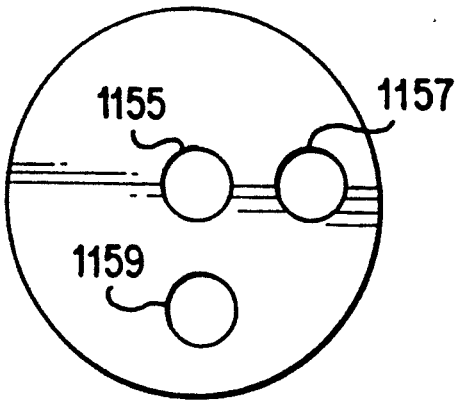

FIG. 11C is a simplified variation of FIG. 11B. The central aperture 1155 is activated for both the vertical and horizontal flow measurements. In addition, for the horizontal direction, aperture 1157 is activated while for the vertical direction, aperture 1159 is activated. The probe of FIG. 11C has the advantage of requiring a less complicated manifold arrangement than that of FIG. 11B. Such an embodiment can save costs on materials reducing the cost of the tool.

FIG. 11D is another alternative embodiment to that shown in FIGS. 11B and 11C. In the case of FIG. 11D, no central aperture is used. Instead, the horizontal measurement is obtained through four linearly aligned openings 1163, 1165, 1167, and 1169. For the vertical direction, openings 1171, 1173, 1175, and 1177 are activated. This embodiment requires a more complicated manifold than that of FIG. 11B because it has eight openings as opposed to five.

Yet another probe aperture arrangement is shown in FIG. 11E. In this configuration, multiple elongate apertures are arranged in patterns on the face of probe 1180 such that a group of apertures may be selected to approximate an elongate aperture. For example, apertures 1182 and 1184 may be selected to approximate a slit-shaped aperture of one orientation, and apertures 1186 and 1188 may be selected to approximate a slit-shaped aperture in an orthogonal direction.

A further probe aperture arrangement is shown in FIG. 11F. In this configuration, multiple elongate apertures are arranged in patterns on the face of probe 1190 such that a single aperture (e.g., aperture 1192) or pair of apertures (e.g. apertures 1192 or 1194) can be selected by means of a set of controllable valves (not shown). Apertures arranged in 45° increments around the probe face allow for selection of apertures most closely oriented in the vertical or horizontal directions when the formation bedding planes cross the borehole at high angles. Central aperture 1196 may be activated in combination with any of the outer apertures to more closely approximate an aperture with a smaller aspect ratio.

While the foregoing describes and illustrates particular preferred embodiments of the invention, it will be understood that many modifications may be made without departing from the spirit of the invention. For example, it is possible to use a single elongate aperture oriented in a first direction while using an aperture of circular cross-section for the other direction. Further, any combination of the described permutations is acceptable for obtaining effective measurements. Therefore, the above descriptions in no way limit the scope of the invention. The following claims are intended to cover any such modifications as fall within the true spirit and scope of the invention.

What is claimed is:

1. An apparatus for estimating permeability of an earth formation in at least one of two orthogonal directions, the formation containing a formation fluid, comprising:

means for measuring a pressure $P_f$ of the formation fluid;

means for creating a first pressure disturbance in the formation fluid by displacing the formation fluid for a first time period at a first flow rate through a probe having an elongate aperture of width W and length L, the aperture being oriented in a first direction;

means for measuring a pressure $P_{p1}$ of the fluid substantially at the end of the first time period; and means for determining a value of permeability in a direction orthogonal to said first direction from aperture width W, aperture length L, measured pressure $P_f$, measured pressure $P_{p1}$, and the flow rate of fluid in the formation.

2. The apparatus of claim 1 wherein the aperture is rectangular.

3. The apparatus of claim 1 including a plurality of apertures in a plane and aligned such that a first axis bisects each of the apertures through the length of each aperture.

4. The apparatus of claim 3 wherein each of said plurality of apertures are elongate.

5. The apparatus of claim 3 including a combination of at least one circular aperture and at least one elongate aperture wherein the at least one elongate aperture has a width, W, substantially equal to the diameter of the at least one circular aperture, said elongate aperture being positioned relative to said at least one circular aperture such that a width, W, of said elongate aperture is bisected by the first axis through the center of the at least one circular aperture.

6. The apparatus of claim 1 further comprising:

means for creating a second pressure disturbance in the formation fluid by displacing fluid for a second time period at a second flow rate through said elongate aperture while said elongate aperture is oriented in a second direction orthogonal to said first direction;

means for measuring a second pressure $P_{p2}$ of the fluid substantially at the end of the second time period; and means for determining a value of permeability in a direction orthogonal to said second direction from aperture width W, aperture length L, measured pressure $P_f$, measured pressure $P_{p2}$, and the second flow rate, of fluid in the formation.

7. The apparatus of claim 6 wherein said probe aperture is rotatable about a central point.

8. The apparatus of claim 6 including:

a substantially circular aperture in a plane having maximum diameter W;

at least one first elongate aperture in the plane having maximum first dimension W and maximum second dimension L, the first elongate aperture being aligned with the circular aperture such that the first dimension of the first elongate aperture is bisected by a first axis through the center of the circular aperture; and at least one second elongate aperture in the plane having maximum first dimension W and maximum second dimension L, the second elongate aperture being aligned with the circular aperture such that the first dimension of the second elongate aperture is bisected by a second axis, orthogonal to the first axis, through the center of the circular aperture.

9. The apparatus of claim 6 including:

a substantially square aperture in a plane having maximum dimensions W by W;

at least one first elongate aperture aligned with said square aperture in the plane having maximum first dimension W and maximum second dimension L such that the first dimension of the first elongate aperture is bisected by a first axis through the center of the square aperture; and at least one second elongate aperture in the plane having a maximum first dimension W and maximum second dimension L, the second elongate aperture being aligned with the square aperture such that the first dimension of the second elongate aperture is bisected by a second axis, orthogonal to the first axis, through the center of the square aperture.

10. The apparatus of claim 9 wherein said elongate openings are rectangular.

11. The apparatus of claim 6 including a plurality of apertures, $A_x$, each having a length and a width and aligned in a plane such that a first axis bisects each of the apertures through the length of each aperture.

12. The apparatus of claim 11 further comprising a second plurality of apertures, $A_y$, each having a length and a width and aligned in the plane such that a second axis bisects each of the apertures through the length of each aperture and the second axis is orthogonal to the first axis.

13. A logging tool for sampling fluid in an earth formation to estimate permeability of the earth formation, comprising:

means for transferring fluid between the earth formation and the logging tool having a first end through which fluid flows;

an elongate aperture at the first end of the means for transferring fluid for contacting the earth formation, said elongate aperture having maximum dimensions of width, W by length, L; and means for measuring permeability of the formation with respect to fluid flowing through the cross sectional area of the elongate aperture as a function of W and L.

14. The logging tool of claim 13 wherein said elongate aperture is rectangular.

15. The logging tool of claim 13 including a plurality of apertures having a length and a width and aligned in a plane such that a first axis bisects each of the apertures through the length of each aperture.

16. The logging tool of claim 15 including a combination of at least one circular aperture and at least one elongate aperture wherein the at least one elongate aperture has a width, W substantially equal to the diameter of the at least one circular aperture, said elongate aperture being positioned relative to said at least one circular aperture such that a width, W of said elongate aperture is bisected by the first axis through the center of the at least one circular aperture.

17. The logging tool of claim 13 wherein said elongate aperture is rotatable about a central point.

18. The logging tool of claim 13 including:

a circular aperture in a plane having maximum diameter W;

at least one first elongate aperture aligned with said circular aperture in the plane having maximum first dimension W and maximum second dimension equal to L such that the first dimension of the first elongate aperture is bisected by a first axis through the center of the circular aperture; and at least one second elongate aperture aligned with said circular aperture, said at least one second elongate aperture having maximum first dimension W and maximum second dimension equal to L such that the first dimension of the second elongate aperture is bisected by a second axis orthogonal to the first axis, through the center of the circular aperture.

19. The logging tool of claim 13 including:

a substantially square aperture in a plane having maximum dimensions W by W;

at least one first elongate aperture in the plane and aligned with said square aperture having maximum first dimension W and maximum second dimension L such that the first dimension of the first elongate aperture is bisected by a first axis through the center of the square aperture; and at least one second elongate aperture in the plane and aligned with said square aperture, said at least one second elongate aperture having maximum first dimension W and maximum second dimension L such that the first dimension of the second elongate aperture is bisected by a second axis orthogonal to the first axis, through the center of the square aperture.

20. The logging tool of claim 19 wherein said elongate apertures are rectangular.

21. A logging tool for sampling fluid in an earth formation to estimate permeability of the earth formation, comprising:

means for transferring fluid between the earth formation and the logging tool having a first end through which fluid flows;

a plurality of apertures aligned in a plane at the first end of the means for transferring fluid for contacting the earth formation, each aperture having a width and a length such that a first axis bisects the width of each of the plurality of apertures and the sum of the lengths of the plurality of apertures is L; and means for measuring permeability of the formation with respect to the fluid flowing through the cross sectional area of the plurality of apertures as a function of the width of each aperture and L.

22. The apparatus of claim 21 including:

a circular aperture $C_c$ in a plane; and at least one circular aperture, $C_x$, in the plane and aligned with said circular aperture $C_c$ wherein a first axis passes through the center of $C_x$ and $C_c$.

23. The apparatus of claim 22 further comprising:

at least one circular aperture, $C_y$, in the plane and aligned with said circular aperture $C_c$ wherein a second axis passes through the center of $C_y$ and $C_c$ orthogonal to the first axis.

24. The apparatus of claim 22 further comprising:

at least two circular apertures, $C_y$, in the plane wherein a second axis passes through the center of the at least two circular apertures $C_y$ orthogonal to the first axis.

* * * * *